US012595526B2

(12) United States Patent
Yang et al.

(10) Patent No.: US 12,595,526 B2
(45) Date of Patent: Apr. 7, 2026

(54) HOT-ROLLED STEEL SHEET FOR HYPER TRAIN TUBE, AND MANUFACTURING METHOD FOR SAME

(71) Applicant: POSCO Co., Ltd, Pohang-si (KR)

(72) Inventors: Hong-Seok Yang, Pohang-si (KR); Hak-Jun Kim, Pohang-si (KR); Han-Sung Kim, Seoul (KR); Seung-Min La, Eschborn (DE); Woo-Yeon Cho, Incheon (KR)

(73) Assignee: POSCO CO., LTD, Pohang-si (KR)

( * ) Notice: Subject to any disclaimer, the term of this patent is extended or adjusted under 35 U.S.C. 154(b) by 364 days.

(21) Appl. No.: 18/039,933

(22) PCT Filed: Dec. 3, 2021

(86) PCT No.: PCT/KR2021/018203
§ 371 (c)(1),
(2) Date: Jun. 1, 2023

(87) PCT Pub. No.: WO2022/124704
PCT Pub. Date: Jun. 16, 2022

(65) Prior Publication Data

US 2024/0018618 A1 Jan. 18, 2024

(30) Foreign Application Priority Data

Dec. 10, 2020 (KR) ..... 10-2020-0172031

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 9/46; C21D 6/005; C21D 6/008; C21D 8/0205; C21D 8/0226;
(Continued)

(56) References Cited

U.S. PATENT DOCUMENTS 6,221,179 B1 4/2001 Yasuhara et al.
6,280,538 B1 8/2001 Soshiroda et al.
(Continued)

FOREIGN PATENT DOCUMENTS

CN 103998639 A 8/2014
CN 107697080 A 2/2018
(Continued)

OTHER PUBLICATIONS

Office Action dated Apr. 30, 2025 issued in corresponding Chinese Patent Application No. 202180083391.6. (Note: JP 2007-291511 A already submitted.).
(Continued)

*Primary Examiner* — Ricardo D Morales
(74) *Attorney, Agent, or Firm* — Morgan Lewis & Bockius LLP

(57) ABSTRACT

According to one aspect of the present invention, a hot-rolled steel sheet and a manufacturing method for same may be provided, wherein the hot-rolled steel sheet has excellent yield strength, vibration damping ratio, electrical resistivity, and low-temperature toughness, and thus has properties suitable for use in a hyper train tube.

10 Claims, 1 Drawing Sheet

(51) Int. Cl.

| | |
|---|---|
| ***C21D 8/02*** | (2006.01) |
| ***C21D 8/0221*** | (2026.01) |
| ***C22C 38/02*** | (2006.01) |
| ***C22C 38/04*** | (2006.01) |
| ***C22C 38/12*** | (2006.01) |

(52) U.S. Cl.
CPC ..... *C21D 8/0226* (2013.01); *C22C 38/02* (2013.01); *C22C 38/04* (2013.01); *C22C 38/12* (2013.01); *C21D 2211/005* (2013.01); *C21D 2211/009* (2013.01)

(58) Field of Classification Search
CPC ..... C21D 2211/005; C21D 2211/009; C22C 38/02; C22C 38/04; C22C 38/12
See application file for complete search history.

(56) References Cited

U.S. PATENT DOCUMENTS

| | | | | |
|---|---|---|---|---|
| 6,425,963 | B1 | 7/2002 | Kaneko et al. | |
| 2002/0179193 | A1* | 12/2002 | Yokoi ..... | C21D 8/0263 148/332 |
| 2013/0233543 | A1 | 9/2013 | Kawamura et al. | |
| 2014/0246128 | A1 | 9/2014 | Takashima et al. | |
| 2014/0332119 | A1 | 11/2014 | Takashima et al. | |
| 2019/0316219 | A1 | 10/2019 | Kang et al. | |
| 2022/0042131 | A1 | 2/2022 | Kim | |
| 2023/0024943 | A1 | 1/2023 | Yang et al. | |

FOREIGN PATENT DOCUMENTS

| | | | | |
|---|---|---|---|---|
| JP | H11-92859 | A | 4/1999 | |
| JP | H11-152544 | A | 6/1999 | |
| JP | 2000-169935 | A | 6/2000 | |
| JP | 2001-226744 | A | 8/2001 | |
| JP | 2005-113172 | A | 4/2005 | |
| JP | 2006-124773 | A | 5/2006 | |
| JP | 2007-291511 | A | 11/2007 | |
| JP | 2012-12623 | A | 1/2012 | |
| JP | 2013-122072 | A | 6/2013 | |
| KR | 10-0511727 | B1 | 8/2005 | |
| KR | 10-2013-0105008 | A | 9/2013 | |
| KR | 10-2015-0007609 | A | 1/2015 | |
| KR | 10-1485237 | B1 | 1/2015 | |
| KR | 10-2016-0078829 | A | 7/2016 | |
| KR | 10-2018-0073074 | A | 7/2018 | |
| KR | 10-2106353 | B1 | 5/2020 | |
| KR | 10-2020-0066508 | A | 6/2020 | |
| KR | 10-2021-0078022 | A | 6/2021 | |
| WO | WO-2020039979 | A1 * | 2/2020 | ..... C22C 38/60 |
| WO | 2020/169411 | A1 | 8/2020 | |

OTHER PUBLICATIONS

Partial Supplementary European Search Report dated May 22, 2025 issued in corresponding European Patent Application No. 21903750.4. (Note: JP 2000-169935 A, and CN 107697080 A already submitted.).

Japanese Office Action dated Jul. 2, 2024 issued in Japanese Patent Application No. 2023-533348.

International Search Report dated Mar. 11, 2022, issued in International Patent Application No. PCT/KR2021/018203 (with English translation).

* cited by examiner

HOT-ROLLED STEEL SHEET FOR HYPER TRAIN TUBE, AND MANUFACTURING METHOD FOR SAME

CROSS-REFERENCE OF RELATED APPLICATIONS

This application is the U.S. National Phase under 35 U.S.C. § 371 of International Patent Application No. PCT/KR2021/018203, filed on Dec. 3, 2021, which in turn claims the benefit of Korean Application No. 10-2020-0172031, filed on Dec. 10, 2020, the disclosures of which applications are incorporated by reference herein.

TECHNICAL FIELD

The present disclosure relates to a hot-rolled steel sheet and a manufacturing method for the same, and more particularly, to a hot-rolled steel sheet having excellent yield strength, a vibration damping ratio, electrical resistivity, and low-temperature toughness, and thus having properties suitable for a hyper tube, and a manufacturing method therefor.

BACKGROUND ART

A train in a vacuum, also known as a hyper tube train, is a system in which a maglev train moves in a vacuum tube. The hyper tube train may operate at an ultra-high speed because there is no friction with air or tracks, which is a main cause of energy loss during train operation. Since it has low energy loss and can save 93% of energy, as compared to an aircraft, the hyper tube trains are in the spotlight as an eco-friendly next-generation transportation means, and active research thereinto is being conducted around the world.

A structure and material of the vacuum tube, used in the ultra-high speed hyper tube train affects system performance or costs. Currently, there are three major materials being studied as a tube material for the hyper tube trains, one of the materials being concrete. A concrete tube is advantageous in terms of costs, but it is difficult to connect individual tubes of about 10 m long to each other. In addition, when a vacuum is implemented, due to pores inside the concrete, there is a disadvantage in that external gas may be introduced into the tube, and a degree of vacuum may be easily broken. One of the other materials that has been studied in detail is a composite material such as carbon fiber, or the like. Composite materials such as carbon fiber, or the like, are lightweight and have high performance, but the high cost thereof is considered to be the biggest disadvantage.

Currently, the most promising material for hyper tubes is steel. Steel is a material that can be mass-produced at low cost. Steel has high stiffness and strength and is a material that is easy to process. Steel is also a material that is easy to assemble or weld when joining tubes or accessories to tubes, and also has an appropriate outgassing rate when maintaining a vacuum. However, since the ultra-high-speed hyper tube train operates at a significantly faster speed than that of current high-speed trains, the safety of passengers and surrounding facilities must be considered as a top priority. Currently, safety standards for ultra-high-speed hyper tube trains have not been established, and the development of materials for tubes to ensure the safety of ultra-high-speed hyper tube trains is also insufficient. In addition, while the hyper tube trains also need to be highly efficient to meet the trend of the times, the development of materials for tubes to maximize energy efficiency of hyper tube trains is also insufficient.

Therefore, there is an urgent need to develop a material for a hyper tube capable of ensuring safety and high efficiency while having processability and outgassing rate suitable for the hyper tube.

PRIOR ART DOCUMENT (Patent Document 1) Korean Patent Registration No. 10-2106353 (published on May 4, 2020)

SUMMARY OF INVENTION

Technical Problem

According to an aspect of the present disclosure, a hot-rolled steel sheet having excellent yield strength, a vibration damping ratio, electrical resistivity, and low-temperature toughness, and thus having properties suitable for a hyper tube, and a manufacturing method therefor.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a hot-rolled steel sheet for a hyper tube includes, by weight %: 0.03 to 0.25% of carbon (C); 1.5 to 2.5% of silicon (Si); 0.8 to 1.8% of manganese (Mn); and a balance of Fe and other inevitable impurities, has a composite structure of ferrite and pearlite as a microstructure, and may satisfy the following Relational expressions 1 to 3.

$$350 \leq 11+394*D^{(-0.5)}+448*[C]+94*[Si]+69*[Mn] \quad \text{[Relational expression 1]}$$

$$100 \leq 186-210*D^{(-0.5)}-121*[C]-13.2*[Si]+137*[Mn] \quad \text{[Relational expression 2]}$$

$$30 \leq 9.5+5.2[C]+13.1*[Si] \quad \text{[Relational expression 3]}$$

In Relational expressions 1 to 3, D refers to an average grain size of ferrite (μm) of the hot-rolled steel sheet, and [C], [Si], and [Mn] refer to contents (wt %) of carbon (C), silicon (Si), and manganese (Mn) of the hot-rolled steel sheet, respectively.

The hot-rolled steel sheet may satisfy the following Relational expression 4.

$$303.78-85.22*\ln(D)>27 \quad \text{[Relational expression 4]}$$

In Relational expression 4, D refers to an average grain size of ferrite (μm) of the hot-rolled steel sheet.

The microstructure of the hot-rolled steel sheet may consist of 60 to 90 area % of ferrite, 10 to 40 area % of pearlite and other inevitable structures.

Total contents of titanium (Ti), niobium (Nb), and vanadium (V) inevitably included in the hot-rolled steel sheet may be less than 0.01% (including 0%).

An average grain size (D) of the ferrite may be 10 to 30 μm.

A yield strength of the hot-rolled steel sheet may be 350 MPa or more, and a Charpy impact energy of the hot-rolled steel sheet may be 27 J or more, based on −20° C., a vibration damping ratio measured for a frequency of 1650 Hz in a flexural vibration mode, after processing the hot-rolled steel sheet into a specimen having a length*width*thickness of 80*20*2 mm may be $100*10^{-6}$ or more, and electrical resistivity may be $30*10^{-8}$ Ωm or more.

A thickness of the hot-rolled steel sheet may be 10 mm or more.

According to an aspect of the present disclosure, a method of manufacturing a hot-rolled steel sheet for a hyper tube may include: an operation of heating a slab including, by wt %, 0.15 to 0.25% of carbon (C), 0.3 to 1.3% of silicon (Si), 1.0 to 2.0% of manganese (Mn), and a balance of Fe and other inevitable impurities, at a heating temperature ($T_1$) of 1100° C. to 1300° C.; hot rolling the heated slab at a finishing delivery temperature ($T_2$) of 900° ° C. to 1000° C. to provide a hot-rolled steel sheet; and coiling the hot-rolled steel sheet at a coiling temperature ($T_3$) of 600° ° C. to 700° C., wherein the heating temperature ($T_1$), the finishing delivery temperature ($T_2$) and the coiling temperature ($T_3$) may satisfy the following Relational expression 5, $$1 \leq 0.0284*[T_1]+0.074*[T_2]+0.045*[T_3]-131 \leq 3 \quad \text{[Relational expression 5]}$$

In Relational expression 5, [$T_1$], [$T_2$] and [$T_3$] are a slab heating temperature ($T_1$, ° C.), a finishing delivery temperature ($T_2$, ° C.) and a coiling temperature ($T_3$, ° C.), respectively.

Total contents of titanium (Ti), niobium (Nb), and vanadium (V) inevitably included in the slab may be less than 0.01% (including 0%).

The slab may satisfy the following Relational expression 3.

$$30 \leq 9.5+5.2[C]+13.1*[Si] \quad \text{[Relational expression 3]}$$

In Relational expression 3, [C], [Si], and [Mn] refer to contents (wt %) of carbon (C), silicon (Si), and manganese (Mn) in the hot-rolled steel sheet, respectively.

The means for solving the above problems do not enumerate all the features of the present invention, and the various features of the present invention and the advantages and effects thereof will be understood in more detail with reference to the specific embodiments and examples below.

Advantageous Effects of Invention

As set forth above, according to an aspect of the present disclosure, a hot-rolled steel sheet having excellent properties such as yield strength, a vibration damping ratio, electrical resistivity, and low-temperature toughness suitable for a hyper tube and a manufacturing method thereof can be provided.

The effect of the present invention is not limited to the above, and may be interpreted to include matters that can be reasonably inferred from the matters described in this specification by those skilled in the art.

BEST MODE FOR INVENTION

Figure 1:
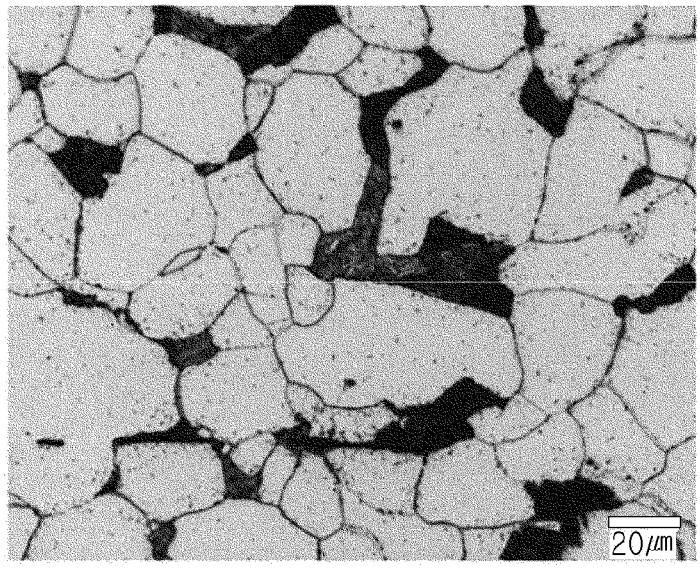
FIG. 1 is an optical microscope image used to observe a microstructure of specimen 1.

The present disclosure relates to a hot-rolled steel sheet for a hyper tube and a method for manufacturing the same. Hereinafter, preferred embodiments of the present disclosure will be described. Embodiments of the present disclosure may be modified in various forms, and the scope of the present disclosure should not be construed as being described limited to the embodiments below. These embodiments are provided to those skilled in the art to further elaborate on the present disclosure.

A hyper tube train is a train that runs inside a tube in a vacuum or sub-vacuum state, and is a next-generation transportation method currently in an early stage of development. The hyper tube train is a means of transportation capable of effectively achieving high speed and high efficiency by eliminating frictional resistance between wheels and tracks and minimizing air resistance. However, when safety of the hyper tube train is not sufficiently secured due to the nature of the hyper tube train operating at ultra-high speed, there is a risk of a major accident. In particular, not only when the vacuum tube is structurally damaged or collapsed, but also when a partial shape of the tube is deformed, a catastrophic accident may occur, and thus, a material for a hyper tube requires more stringent safety. As a result of in-depth research, the inventors of the present invention have found that the following physical properties are important in a material for the vacuum tube to secure the safety of the hyper tube train.

The first property required of a material for a vacuum tube to ensure safety is a high-strength property. Since the vacuum train tube moves through an inside of the vacuum tube, a material for the vacuum tube is required to have sufficient strength as a structure. In addition, since the inside of the vacuum tube must be maintained in a vacuum or sub-vacuum state, it is necessary to have sufficient high-strength properties so that a shape of the tube is not deformed due to a pressure difference between the inside and outside.

The second property required of a material for a vacuum tube to ensure safety is vibration damping ability. In the hyper tube train, a pod with several or dozens of people on board passes through the inside of the vacuum tube at intervals of several tens of seconds to several minutes. When a subsequent pod passes, a preceding pod has passed therethrough, vibrations may be amplified in the vacuum tube and resonance may occur, and in serious cases, the tube may be damaged. Therefore, when a material having a vibration damping ratio of a certain level or higher is applied to the vacuum tube, vibration in the tube after the preceding pod passes therethrough may be effectively reduced, which contributes to effectively reducing the safety of the hyper tube train.

The third property required for a material for a vacuum tube to ensure safety is low-temperature toughness. The hyper tube train may also operate in polar regions or in deep waters. Since a steel material tends to be more easily damaged in a low-temperature or cryogenic environment, when the steel material is applied to a vacuum tube, it is necessary to have low temperature toughness of a certain level or higher in order to secure safety.

In addition, since demand for an eco-friendly transportation means is rapidly increasing worldwide, there is a need to maximize energy efficiency of hyper tube trains as well. An electromagnetic suspension (EMS) method is a method of levitating a train using attractive force between electromagnets, and an electrodynamic suspension (EMS) method is a method of levitating a train using repulsive force between superconductors and magnets. Thereamong, when using the EDS method, a strong magnetic field may be formed therearound, compared to when using the EMS method. When a train passes through the tube, a change occurs in a magnetic field to form an induced current in the tube, which may cause energy loss. Therefore, it is necessary to reduce such energy loss by increasing the electrical resistance of the tube material, and it is necessary to have an electrical resistivity (p) of a certain level or higher to secure energy efficiency.

The inventor of the present invention has recognized that excellent yield strength, a vibration damping ratio, electrical resistivity, and low-temperature toughness could be compatible, through in-depth research, by strictly controlling an alloy composition content and microstructure of the steel sheet, thereby deriving the present invention.

Hereinafter, a hot-rolled steel sheet for a hyper tube according to an aspect of the present disclosure will be described in greater detail.

According to an aspect of the present disclosure, a hot-rolled steel for a hyper tube may include, by wt %, 0.03 to 0.25% of carbon (C), 1.5 to 2.5% of silicon (Si), and 0.8 to 1.8% of manganese (Mn), and a balance of Fe and inevitable impurities, have a composite structure of ferrite and pearlite as a microstructure, satisfy the following Relational expressions 1 to 3, and further satisfy the following Relational expression 4.

$$350 \leq 11+394*D^{(-0.5)}+448*[C]+94*[Si]+69*[Mn] \quad \text{[Relational expression 1]}$$

$$100 \leq 186-210*D^{(-0.5)}-121*[C]-13.2*[Si]+137*[Mn] \quad \text{[Relational expression 2]}$$

$$30 \leq 9.5+5.2[C]+13.1*[Si] \quad \text{[Relational expression 3]}$$

$$303.78-85.22*\ln(D)>27 \quad \text{[Relational expression 4]}$$

In Relational expressions 1 to 4, D is an average grain size of ferrite (μm) of the hot-rolled steel sheet, respectively.

Hereinafter, a steel composition included in the hot-rolled steel sheet of the present disclosure will be described in more detail. Hereinafter, % herein representing a content of each element is based on weight unless otherwise specified.

Carbon (C): 0.03 to 0.25%

Carbon (C) is a component that greatly affects strength of a steel sheet. In the present disclosure, 0.03% or more of carbon (C) may be included in order to secure strength required for a structure. A preferable lower limit of a content of carbon (C) may be 0.05%, and a more preferable lower limit of the content of carbon (C) may be 0.07%. On the other hand, when the content of carbon (C) is excessive, toughness of a material may be lowered, the weldability may be lowered, and a yield ratio may be increased. In addition, when the content of carbon (C) is excessive, since it is difficult to coarsen crystal grains, in the present disclosure, an upper limit of the content of carbon (C) may be limited to 0.25%. A preferable upper limit of the content of carbon (C) may be 0.2%, and a more preferable upper limit of the content of carbon (C) may be 0.15%.

Silicon (Si): 1.5 to 2.5%

Since silicon (Si) oxygenates to form a slag in a steel-making stage, silicon (Si) tends to be removed along with oxygen. In addition, silicon (Si) is also a component that effectively contributes to improving strength and electrical resistivity of a material. Accordingly, in the present disclosure, 1.5% or more of silicon (Si) may be included for such an effect. A preferable lower limit of a content of silicon (Si) may be 1.6%, and a more preferable lower limit of the content of silicon (Si) may be 1.8%. On the other hand, when the content of silicon (Si) is excessive, peeling of surface scale may be hindered and product surface quality may be deteriorated. In addition, when the content of silicon (Si) is excessive, low-temperature toughness of a base material and a welded zone decreases, increasing a risk of fractures during use of the material. In the present disclosure, the content of silicon (Si) may be limited to 2.5% or less. A preferable upper limit of the content of silicon (Si) may be 2.3%, and a more preferable upper limit of the content of silicon (Si) may be 2.0%.

Manganese (Mn): 0.8 to 1.8%

Manganese (Mn) is a component improving strength and hardenability of steel. Therefore, in the present disclosure, 0.8% or more of manganese (Mn) may be included in order to secure such an effect. A preferable lower limit of a content of manganese (Mn) may be 1.0%, and a more preferable lower limit of the content of manganese (Mn) may be 1.1%. On the other hand, when the content of manganese (Mn) is excessive, material deviation may occur due to central segregation, and crack propagation resistance may be inferior. In addition, when the content of manganese (Mn) is excessive, toughness of steel may be deteriorated. In the present disclosure, the content of manganese (Mn) may be limited to 1.8% or less. A preferable upper limit of the content of manganese (Mn) may be 1.6%, and a more preferable upper limit of the content of manganese (Mn) may be 1.5%.

Other than the above-described steel composition, the hot-rolled steel sheet according to an aspect of the present disclosure may include a balance of Fe and other inevitable impurities. The inevitable impurities may be unintentionally incorporated from raw materials or surrounding environments in a general manufacturing process and cannot be completely excluded. Since these impurities may be known to a person skilled in the art, all thereof are not specifically mentioned in the present specification. In addition, additional addition of effective components other than the above-mentioned component is not completely excluded.

The hot-rolled steel sheet of the present disclosure may actively addition of titanium (Ti), niobium (Nb), and vanadium (V), and even if these components are inevitably included, a total content thereof may be limited to 0.01% or less (including 0%). Titanium (Ti), niobium (Nb), and vanadium (V) are typical precipitation strengthening elements, and are components that effectively contribute to improving the strength of steel by generating fine carbonitrides. However, since titanium (Ti), niobium (Nb), and vanadium (V) excessively refine a microstructure of the steel and adversely affect vibration damping performance, in the present disclosure, it is intended to actively suppress these components. In addition, titanium (Ti), niobium (Nb), and vanadium (V) are expensive components, and are not preferable from the viewpoint of economic efficiency. In the present disclosure, these components are not artificially added, and even when these components are inevitably added, a total content of these components may be actively suppressed to be less than 0.01%. A preferable total content of these components may be 0.005% or less, and a more preferable total content of these components may be 0%.

The hot-rolled steel sheet according to an aspect of the present disclosure may have a composite structure comprised of ferrite and pearlite as a microstructure. In the present disclosure, formation of a low-temperature structure such as bainite, martensite, and the like, may be actively suppressed. The low-temperature structure such as bainite, martensite, and the like, has high strength and low yield ratio, so that excellent physical properties may be exhibited as a structural material. However, since the hot-rolled steel sheet for a hyper tube according to an example of the present disclosure is thick at a level of 10 mm or more, even when a low-temperature structure is introduced, physical property deviation may occur in a thickness direction of the steel sheet. This is because the low-temperature structure is formed only on a surface of the steel sheet, and it is difficult to sufficiently form the low-temperature structure to a central portion of the steel sheet.

Therefore, in the present disclosure, in order to reduce deviation of physical properties, the microstructure of the steel sheet may be comprised of a composite structure comprised of ferrite and pearlite, and even if the low-temperature structure such as bainite and martensite is inevitably formed, a fraction thereof may be actively suppressed by 1 area % or less (including 0%). In terms of securing physical properties, the fraction of ferrite may be 60 to 90 area %, and the fraction of pearlite may be 10 to 40 area %.

In order to simultaneously secure the desired yield strength, a vibration damping ratio, and low-temperature toughness, in the present disclosure, an average grain size of ferrite may be limited to a certain range. As the grain size thereof increases, it is advantageous to secure a vibration damping ratio, so the average grain size of ferrite may be limited to 10 μm or more. A preferable average grain size may be greater than 10 μm, and a more preferable average grain size may be greater than 15 μm. On the other hand, when the grain size is excessively large, the strength and low-temperature toughness of the material are deteriorated, so in the present disclosure, the average grain size of ferrite may be limited to 30 μm or less. A preferable upper limit of the average grain size may be 25 μm.

The inventor of the present disclosure conducted in-depth research on methods for securing the stability and energy efficiency of materials for a hyper tube train, as a result thereof, the inventor of the present invention has found that yield strength, a vibration damping ratio, and electrical resistivity may be simultaneously secured, when the contents of carbon (C), silicon (Si), and manganese (Mn) and the average grain size of ferrite are controlled within a certain range in a low alloy-based steel sheet as in the present disclosure.

$$350 \le 11+394*D^{(-0.5)}+448*[C]+94*[Si]+69*[Mn] \quad \text{[Relational expression 1]}$$

$$100 \le 186-210*D^{(-0.5)}-121*[C]-13.2*[Si]+137*[Mn] \quad \text{[Relational expression 2]}$$

$$30 \le 9.5+5.2[C]+13.1*[Si] \quad \text{[Relational expression 3]}$$

In Relational expressions 1 to 3, D refers to an average grain size of ferrite (μm) of the hot-rolled steel sheet, and [C], [Si], and [Mn] refer to contents (wt %) of carbon (C), silicon (Si), manganese (Mn) of the hot-rolled steel sheet, respectively.

Since the hot-rolled steel sheet for a hyper tube train of the present disclosure simultaneously satisfies Relational expressions 1 to 3, the desired yield strength, vibration damping ratio, and electrical resistivity may be simultaneously secured.

In addition, the inventor of the present disclosure has found that low-temperature toughness may be secured when the average grain size of ferrite is controlled within a certain range in the steel sheet having the component system of the present disclosure, resulting in additionally deriving the following Relational expression 4.

$$303.78-85.22*\ln(D)>27 \quad \text{[Relational expression 4]}$$

In the above Relational expression 4, D is an average grain size of ferrite of the hot-rolled steel sheet (μm).

Since the hot-rolled steel sheet for a vacuum train tube of the present invention additionally satisfies Relational expression 4, desired low-temperature toughness may be effectively secured.

The hot-rolled steel sheet for a vacuum train tube of the present disclosure may have a yield strength of 350 MPa or more and a Charpy impact energy of −20° C. or more of 27 J or more. Therefore, the hot-rolled steel sheet for a hyper tube according to the present disclosure may secure strength and low-temperature toughness suitable for a structural material, thereby effectively securing structural safety of the hyper tube.

The hot-rolled steel sheet for a hyper tube train of the present disclosure may have a vibration damping ratio of $100*10^{-6}$ or more. Here, the vibration damping ratio refers to a vibration damping ratio measured for a frequency of 1650 Hz after being impacted in a flexural vibration mode for a specimen having a length*width*thickness of 80*20*2 mm.

Since the hot-rolled steel sheet for a hyper tube of the present disclosure has a vibration damping ratio of $100*10^{-6}$ or more, it is possible to effectively suppress vibration amplification in a vacuum tube, and effectively prevent damage to the hyper tube caused by vibration. The hot-rolled steel sheet for a hyper tube of the present disclosure may have electrical resistivity of $30*10^{-8}$ Ωm or more, so that energy efficiency during operation of the hyper tube train can be effectively secured.

Therefore, according to an aspect of the present disclosure, it is possible to provide a hot-rolled steel sheet having excellent yield strength, a vibration damping ratio, electrical resistivity, and low-temperature toughness and thus having properties suitable for a hyper tube.

Hereinafter, a method for manufacturing a hot-rolled steel sheet for a hyper tube according to an aspect of the present disclosure will be described in more detail.

According to an aspect of the present disclosure, a manufacturing method for a hot-rolled steel sheet for a hyper tube is provided, the manufacturing method including: an operation of heating a slab including, by wt %, 0.15 to 0.25% of carbon (C), 0.3 to 1.3% of silicon (Si), 1.0 to 2.0% of manganese (Mn), and a balance of Fe and other inevitable impurities, at a heating temperature ($T_1$) of 1100° ° C. to 1300° C.; hot rolling the heated slab at a finishing delivery temperature ($T_2$) of 900° C. to 1000° ° C. to provide a hot-rolled steel sheet; and coiling the hot-rolled steel sheet at a coiling temperature ($T_3$) of 600° C. to 700° C., wherein the heating temperature ($T_1$), the finishing delivery temperature ($T_2$) and the coiling temperature ($T_3$) satisfy the following Relational expression 5, $$1 \le 0.0284*[T_1]+0.074*[T_2]+0.045*[T_3]-131 \le 3 \quad \text{[Relational expression 5]}$$

In Relational expression 5, $[T_1]$, $[T_2]$ and $[T_3]$ refer to a slab heating temperature ($T_1$, ° C.), a finishing delivery temperature ($T_1$, ° C.) and a coiling temperature ($T_1$, ° C.), respectively.

Preparing and Heating Steel Slab

A steel slab having a predetermined alloy composition is prepared. Since the steel slab of the present disclosure has an alloy composition corresponding to the above-described hot-rolled steel sheet, a description of the alloy composition of the steel slab is replaced with the description of the alloy composition of the above-described hot-rolled steel sheet.

The prepared steel slab may be heated at a heating temperature ($T_1$) of 1100° C. to 1300° C. Considering a rolling load during hot rolling, the steel slab may be heated in a temperature range of 1100° C. or higher. In particular, since, in the present disclosure, a certain size or more of microstructure is intended to be introduced, a preferable heating temperature of the steel slab may be 1200° C. or higher.

A more preferable steel slab heating temperature may be 1250° C. or higher. On the other hand, when the steel slab heating temperature is excessively high, surface quality deterioration due to scale generation may be concerned, so in the present disclosure, the steel slab heating temperature may be limited to 1300° C. or lower.

Hot Rolling

The heated steel slab may be hot rolled at a finishing delivery temperature ($T_2$) of 900° C. to 1000° C. to provide a hot-rolled steel sheet. The steel sheet provided by the hot rolling of the present disclosure may have a thickness of 10 μm or more.

During hot rolling, crystal grains are deformed as a material thereof is rolled, but re-crystallized soon. Through this process, a coarse and non-uniform structure becomes micronized and homogenized. The number of important process surfaces during hot rolling is a finishing delivery temperature (FDT), which is a temperature at the end of rolling. This is because the grain size of a final microstructure may be controlled according to the finishing delivery temperature. Since, in the present disclosure, the final microstructure is intended to be controlled to a level of a certain size or more, hot rolling may be performed at a finishing delivery temperature of 900° C. or higher. A preferable finishing delivery temperature may be 950° C. or higher. On the other hand, when the finishing delivery temperature is excessively high, the final microstructure may be excessively coarsely implemented, and in the present disclosure, an upper limit of the finishing delivery temperature may be limited to 1000° C.

Coiling

The hot-rolled steel sheet provided by hot rolling may be coiled at a coiling temperature ($T_3$) of 600° C. to 700° C. after undergoing water cooling. Since, in the present disclosure, a composite structure of ferrite and pearlite is intended to be implemented as a final structure, coiling may be performed in a temperature range of 600° C. or higher. Since, in the present disclosure, a certain size or more of final microstructure is intended to be implemented, it is more preferable that coiling is performed in a temperature range of 650° C. or higher. However, when a coiling temperature is excessively high, a coarse microstructure may be formed or surface quality may be inferior, so, in the present disclosure, an upper limit of the coiling temperature may be limited to 700° C.

The inventor of the present invention conducted in-depth research on technical means for controlling a grain size of a final microstructure, and in order to control the crystal grain size of the final microstructure in a component system of the present invention, the inventors have found that the heating temperature ($T_1$) during heating of the steel slab, the finishing delivery temperature ($T_2$) during hot rolling, and the coiling temperature ($T_3$) during coiling of the rolled steel sheet not only must be independently controlled to satisfy a certain range, but also these slab heating temperature ($T_1$), the finishing delivery temperature ($T_2$) and coiling temperature ($T_3$) must be controlled within a certain range in connection with each other, so that the following Relational expression 5 is derived.

$$1 \le 0.0284*[T_1]+0.074*[T_2]+0.045*[T_3]-131 \le 3 \quad \text{[Relational expression 5]}$$

In Relational expression 5, $[T_1]$, $[T_2]$ and $[T_3]$ mean a slab heating temperature ($T_1$, ° C.), finishing delivery temperature ($T_2$, ° C.) and a coiling temperature ($T_3$, ° C.), respectively.

In a manufacturing method for a hot-rolled steel sheet for a hyper tube according to an aspect of the present disclosure, since a slab is heated at a heating temperature ($T_1$) of 1100° C. to 1300° C., and hot rolling is performed at a finishing delivery temperature ($T_2$) of 900° C. to 1000° C., and a hot-rolled steel sheet is coiled at a coiling temperature ($T_3$) of 600° C. to 700° C., as well as process conditions controlled so that the slab heating temperature ($T_1$), the finishing delivery temperature ($T_2$), and the coiling temperature ($T_3$) satisfy Relational expression 4, a microstructure of a target hot-rolled steel sheet can be effectively implemented.

The hot-rolled steel sheet manufactured by the above-described manufacturing method may satisfy the following Relational expressions 1 to 3, and may further satisfy the following Relational expression 4.

$$350 \le 11+394*D^{(-0.5)}+448*[C]+94*[Si]+69*[Mn] \quad \text{[Relational expression 1]}$$

$$100 \le 186-210*D^{(-0.5)}-121*[C]-13.2*[Si]+137*[Mn] \quad \text{[Relational expression 2]}$$

$$30 \le 9.5+5.2[C]+13.1*[Si] \quad \text{[Relational expression 3]}$$

$$303.78-85.22*\ln(D)>27 \quad \text{[Relational expression 4]}$$

In Relational expressions 1 to 4, D refers to an average grain size of ferrite (μm) of the hot-rolled steel sheet, and [C], [Si] and [Mn] refer to contents (wt %) of carbon (C), silicon (Si), and manganese (Mn) of the hot-rolled steel sheet, respectively.

The hot-rolled steel sheet manufactured by the above-described manufacturing method not only has a yield strength of 350 MPa or more and a Charpy impact energy of −20° C. of 27 J or more, but also has a vibration damping ratio of $100*10^{-6}$ or more, measured for a frequency of 1650 Hz in a flexural vibration mode by preparing a specimen having a length*width*thickness of 80*20*2 mm, and has electrical resistivity of $30*10^{-8}$ Ωm or more.

Therefore, according to an aspect of the present disclosure, it is possible to provide a method for manufacturing a hot-rolled steel sheet having excellent yield strength, a vibration damping ratio, electrical resistivity, and low-temperature toughness and thus having properties suitable for a hyper tube and a manufacturing method therefor.

Mode for Invention

Hereinafter, a hot-rolled steel sheet for a hyper tube of the present disclosure and a manufacturing method therefor will be described in more detail through specific examples. It should be noted that the following examples are only for understanding of the present invention, and are not intended to specify the scope of the present invention. The scope of the present invention may be determined by the matters described in the claims and the matters reasonably inferred therefrom.

EXAMPLE

After preparing a steel slab having a thickness of 250 mm provided with an alloy composition of Table 1 below, a hot-rolled steel sheet having a thickness of 15 mm was manufactured by applying process conditions of Table 2. Alloy components not described in Table 1 below refer to impurities and a balance of Fe, and "–" indicates a case close to 0 wt % within an error range.

TABLE 1

| STEEL | ALLOY COMPOSITION (BY WEIGHT %) | | | | | |
|---|---|---|---|---|---|---|
| TYPE | C | Si | Mn | Ti | Nb | V |
| A | 0.07 | 2.0 | 1.3 | — | — | — |
| B | 0.1 | 1.8 | 1.5 | — | — | — |
| C | 0.07 | 1.8 | 1.1 | — | 0.045 | — |
| D | 0.11 | 1.0 | 0.8 | — | — | — |

TABLE 1-continued

| STEEL | ALLOY COMPOSITION (BY WEIGHT %) | | | | | |
|---|---|---|---|---|---|---|
| TYPE | C | Si | Mn | Ti | Nb | V |
| E | 0.02 | 0.5 | 1.1 | — | — | — |
| F | 0.3 | 2.0 | 1.1 | — | — | — |

TABLE 2

| | | PROCESS CONDITIONS | | | |
|---|---|---|---|---|---|
| SPECIMEN No. | STEEL TYPE | SLAB HEATING TEMPERATURE ($T_1$, ° C.), | FINISHING DELIVERY TEMPERATURE ($T_2$, ° C.) | WINDING TEMPERATURE ($T_3$, ° C.) | RELATIONAL EXPRESSION 5 |
| 1 | A | 1250 | 950 | 650 | 1.2 |
| 2 | A | 1200 | 900 | 650 | −3.8 |
| 3 | A | 1300 | 1000 | 750 | 10.7 |
| 4 | B | 1200 | 950 | 680 | 1.1 |
| 5 | C | 1250 | 950 | 660 | 1.2 |
| 6 | D | 1250 | 960 | 650 | 1.9 |
| 7 | E | 1250 | 950 | 650 | 1.2 |
| 8 | F | 1250 | 950 | 650 | 1.2 |

A microstructure and mechanical properties of each specimen were analyzed and described in Table 3, and whether Relational expressions 1 to 4 of each specimen are satisfied was described in Table 3 together. The microstructure was measured by using an optical microscope with a magnification of 500 after etching each specimen with a nital etching method. A grain size of ferrite was measured according to ASTM E112. FIG. 1 is an image of an optical microscope used to observe the microstructure of specimen 1.

Mechanical properties were measured according to KS B 0802 and KS B 0810, and a measured yield strength, yield ratio, and Charpy impact toughness at −21° C. were described in Table 3 together. Electrical resistivity was measured according to KS C IEC 60404, and values thereof were described in Table 3 together.

After preparing a specimen having a length*width*thickness of 80*20*2 mm, a vibration damping ratio was measured at room temperature using IMCE's RFDA LTV800. After being impacted in a flexural vibration mode, the vibration damping ratio in a 1650 Hz region corresponding to a $1^{st}$ mode of vibration modes of the specimen was measured and analyzed, and results thereof were described in Table 3 together.

TABLE 3

| SPECIMEN No. | STEEL TYPE | MICRO-STRUCTURE | grain average size of ferrite (D, μm) | RELATIONAL EXPRESSION 1 | RELATIONAL EXPRESSION 2 | RELATIONAL EXPRESSION 3 | RELATIONAL EXPRESSION 4 | VIBRATION DAMPING RATIO ($*10^{-6}$) | YIELD STRENGTH (MPa) | ELECTRICAL RESISTIVITY ($*10^{-8}$ Ωm) | CHARPY ENERGY (J, @−21° C.) |
|---|---|---|---|---|---|---|---|---|---|---|---|
| 1 | A | F + P | 20 | 408.2 | 122.0 | 43.6 | 48.5 | 122 | 405 | 44 | 39 |
| 2 | A | F + P | 9 | 452.4 | 98.9 | 43.6 | 116.5 | 96 | 425 | 45 | 82 |
| 3 | A | F + P | 35 | 386.7 | 133.4 | 43.6 | 0.8 | 132 | 358 | 43 | 2 |
| 4 | B | F + P | 22 | 412.5 | 125.9 | 42.3 | 40.4 | 130 | 410 | 42 | 41 |
| 5 | C | F + P | 8 | 426.8 | 94.6 | 39.8 | 126.6 | 95 | 430 | 38 | 35 |
| 6 | D | F + P | 24 | 289.9 | 127.6 | 27.8 | 32.9 | 132 | 290 | 28 | 31 |
| 7 | E | F + P | 22 | 320.9 | 134.1 | 35.6 | 40.4 | 132 | 322 | 36 | 37 |
| 8 | F | F + P | 21 | 495.3 | 92.5 | 43.6 | 44.3 | 95 | 470 | 79 | 41 |

As illustrated in Tables 1 to 3, it can be confirmed that specimens satisfying the alloy composition, process conditions, and Relational expressions 1 to 4 of the present disclosure simultaneously satisfy to have a yield strength of 350 MPa or more, a Charpy impact energy of −20° C. of 27 J or more, and electrical resistivity of $30*10^{-8}$ Ωm or more, and a vibration damping ratio of $100*10^{-6}$ or more, while specimens not satisfying any one or more of the conditions proposed by the present disclosure simultaneously satisfy to have a yield strength of 350 MPa or more, a Charpy impact energy of −20° C. of 27 J or more, electrical resistivity of $30*10^{-8}$ Ωm or more, and a vibration damping ratio of $100*10^{-6}$ or more.

Figure 2:
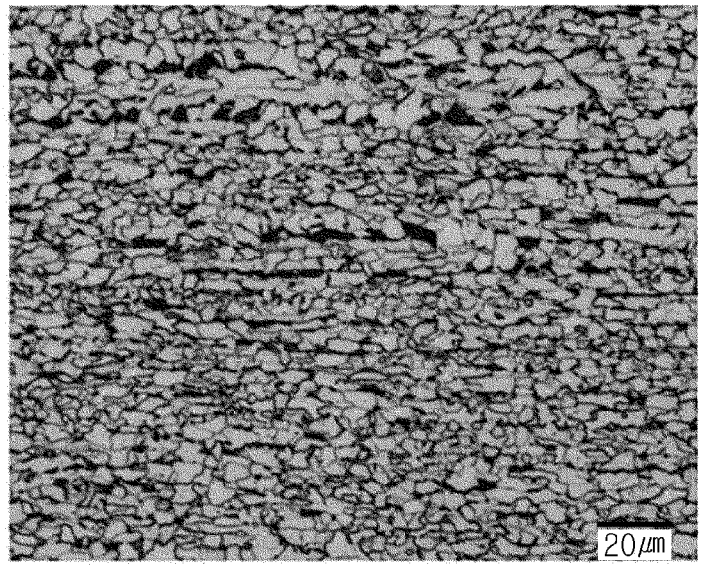
FIG. 2 is an optical microscope photograph of EN-S355, which is a conventional structural steel material.

In addition, for comparison with conventional materials, a test was conducted on EN-S355, a conventional structural steel material, under the same conditions, and in the case of EN-S355, it could be confirmed that a vibration damping ratio measured under the same conditions was only a level of $60*10^{-6}$. FIG. 2 is an image by observing a microstructure of EN-S355 taken using an optical microscope.

Therefore, according to an aspect of the present disclosure, it is possible to provide a hot-rolled steel sheet having excellent yield strength, a vibration damping ratio, electrical resistivity, and low-temperature toughness and thus having properties suitable for a hyper tube and a manufacturing method therefor.

Although the present disclosure has been described in detail through examples above, other types of examples are also possible. Therefore, the technical spirit and scope of the claims set forth below are not limited by the embodiments.

While example embodiments have been shown and described above, it will be apparent to those skilled in the art that modifications and variations could be made without departing from the scope of the present disclosure as defined by the appended claims.

The invention claimed is:

1. A hot-rolled steel sheet for a hyper tube, comprising, by weight %: 0.03 to 0.25% of carbon (C); 1.5 to 2.5 of silicon (Si); 0.8 to 1.8% of manganese (Mn), and a balance of Fe and other inevitable impurities, having a composite structure of ferrite and pearlite as a microstructure, and satisfying the following Relational expressions 1 to 3, wherein low-temperature structure of 1 area % or less (including 0%) is included as the microstructure, and wherein the low-temperature structure includes bainite and martensite, $$350 \le 11+394*D^{(-0.5)}+448*[C]+94*[Si]+69*[Mn] \quad \text{[Relational expression 1]}$$

$$100 \le 186-210*D^{(-0.5)}-121*[C]-13.2*[Si]+137*[Mn] \quad \text{[Relational expression 2]}$$

$$30 \le 9.5+5.2[C]+13.1*[Si] \quad \text{[Relational expression 3]}$$

in Relational expressions 1 to 3, D refers to an average grain size of ferrite (μm) of the hot-rolled steel sheet, and [C], [Si], and [Mn] refer to contents (% by weight) of carbon (C), silicon (Si), and manganese (Mn) of the hot-rolled steel sheet, respectively.

2. The hot-rolled steel sheet for a hyper tube of claim 1, wherein the hot-rolled steel sheet satisfies the following Relational expression 4, $$303.78-85.22*\ln(D)>27 \quad \text{[Relational expression 4]}$$

in Relational expression 4, D refers to an average grain size of ferrite (μm) of the hot-rolled steel sheet.

3. The hot-rolled steel sheet for a hyper tube of claim 1, wherein the microstructure of the hot-rolled steel sheet is comprised of 60 to 90 area % of ferrite, 10 to 40 area % of pearlite, and other inevitable structures.

4. The hot-rolled steel sheet for a hyper tube of claim 1, wherein total contents of titanium (Ti), niobium (Nb), and vanadium (V) inevitably included in the hot-rolled steel sheet are less than 0.01% (including 0%).

5. The hot-rolled steel sheet for a hyper tube of claim 1, wherein the average grain size (D) of the ferrite is 10 to 30 μm.

6. The hot-rolled steel sheet for a hyper tube of claim 1, wherein a yield strength of the hot-rolled steel sheet is 350 MPa or more, a Charpy impact energy of the hot-rolled steel sheet is 27 J or more, based on −20° C., a vibration damping ratio measured for a frequency of 1650 Hz in a flexural vibration mode after processing the hot-rolled steel sheet into a specimen having a length*width*thickness of 80*20*2 mm is $100*10^{-6}$ or more, and electrical resistivity thereof is $30*10^{-8}$ Ωm or more.

7. The hot-rolled steel sheet for a hyper tube of claim 1, wherein a thickness of the hot-rolled steel sheet is 10 mm or more.

8. A manufacturing method for a hot-rolled steel sheet for a hyper tube, comprising:

an operation of heating a slab including, by wt %, 0.03 to 0.25% of carbon (C), 1.5 to 2.5% of silicon (Si), 0.8 to 1.8% of manganese (Mn), and a balance of Fe and other inevitable impurities, at a heating temperature ($T_1$) of 1100° C. to 1300° C.;

hot rolling the heated slab at a finishing delivery temperature ($T_2$) of 900° C. to 1000° C. to provide a hot-rolled steel sheet; and coiling the hot-rolled steel sheet at a coiling temperature (T3) of 600° C. to 700° C., wherein the heating temperature (T1), the finishing delivery temperature (T2), and the coiling temperature ($T_3$) satisfy the following Relational expression 5, $$1 \le 0.0284*[T_1]+0.074*[T_2]+0.045*[T_3]-131 \le 3 \quad \text{[Relational expression 5]}$$

in Relational expression 5, $[T_1]$, $[T_2]$ and $[T_3]$ refer to a slab heating temperature ($T_1$, ° C.), a finishing delivery temperature ($T_2$, ° C.) and a coiling temperature ($T_3$, ° C.), respectively.

9. The manufacturing method for a hot-rolled steel sheet for a hyper tube of claim 8, wherein total contents of titanium (Ti), niobium (Nb) and vanadium (V) inevitably included in the slab are less than 0.01% (including 0%).

10. The manufacturing method for a hot-rolled steel sheet for a hyper tube of claim 8, wherein the slab satisfies the following Relational expression 3, $$30 \le 9.5+5.2[C]+13.1*[Si] \quad \text{[Relational expression 3]}$$

where [C], [Si], and [Mn] are contents (wt %) of carbon (C), silicon (Si), and manganese (Mn) in the hot-rolled steel sheet, respectively.

* * * * *